US007335148B2

(12) United States Patent
Tsutsui et al.

(10) Patent No.: US 7,335,148 B2
(45) Date of Patent: Feb. 26, 2008

(54) METHOD AND APPARATUS FOR MANUFACTURING A BAG EQUIPPED WITH SPOUTS

(75) Inventors: Shoji Tsutsui, Iwakuni (JP); Kakue Nakamoto, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 1 day.

(21) Appl. No.: 11/356,506

(22) Filed: Feb. 17, 2006

(65) Prior Publication Data

US 2006/0189466 A1 Aug. 24, 2006

(30) Foreign Application Priority Data

Feb. 18, 2005 (JP) ..... 2005-042928

(51) Int. Cl.
*B31B 1/84* (2006.01)
*B31B 1/90* (2006.01)
*B65B 61/18* (2006.01)

(52) U.S. Cl. ..... 493/210; 493/212; 493/929; 153/133.2

(58) Field of Classification Search ..... 53/133.1, 53/284, 133.2, 410, 284.7; 493/210, 927, 493/212–214, 929
See application file for complete search history.

(56) References Cited

U.S. PATENT DOCUMENTS 5,855,544 A * 1/1999 Buchanan ..... 493/102
6,745,540 B2 * 6/2004 Hiramoto et al. ..... 53/133.2
6,751,928 B2 * 6/2004 Hiramoto et al. ..... 53/133.2
6,810,636 B2 * 11/2004 Resterhouse ..... 53/133.2

FOREIGN PATENT DOCUMENTS

| | | |
|---|---|---|
| EP | 0 539 800 | 5/1993 |
| JP | 10-291509 | 11/1998 |
| JP | 10-323920 | 12/1998 |
| JP | 2001-293798 | 10/2001 |
| JP | 2004-136904 | 5/2004 |

* cited by examiner

*Primary Examiner*—Hemant M. Desai
(74) *Attorney, Agent, or Firm*—William L. Androlia; H. Henry Koda

(57) ABSTRACT

An intermittently rotating table-type apparatus for manufacturing a bag equipped with spout(s). The apparatus attaches spout(s) to at least one of the mouths of a bag that are at both shoulders of the bag. The mouth(s) of the bag is expanded by bag mouth suction cups, and the main body of the bag is expanded by main body suction cups; and then the spout(s) is inserted in the bag mouth(s), and the inserted spout(s) is held by spout gripping members. When the bag is moved by the rotation of the table, a suction cup arm that supplies suction air to the suction cup and the suction cup are moved to follow the movement of the bag; and after the sealing is made to the bag and spout(s), the arm and the suction cup return to their original positions.

10 Claims, 8 Drawing Sheets

METHOD AND APPARATUS FOR MANUFACTURING A BAG EQUIPPED WITH SPOUTS

BACKGROUND OF THE INVENTION

1. Field of the Invention

The present invention relates to a method and apparatus for manufacturing a bag equipped with a spout(s) by inserting a spout(s) in the mouth(s) of a bag and sealing the spout(s) and bag mouth(s) (including sealing of the opening part of the bag mouth(s)).

2. Description of the Related Art

Japanese Patent Application Laid-Open (Kokai) No. H10-291509 discloses an apparatus in which the chain of a rotary apparatus is provided with a plurality of holding means and is intermittently rotated, spouts are supplied to the holding means and are transported along the movement path of the chain, and in the course of this movement the spout and bag are sealed, thus manufacturing a bag equipped with a spout; then steps are performed such as evacuating the bag interior and filling it with contents, etc. In the process of manufacturing a bag equipped with a spout, a halted bag with its bag mouth opened is moved horizontally toward the spout in the insertion position, thus allowing the bag to overlap the spout (insertion of the spout), and then the spout and bag are sealed by a heating member.

Japanese Patent Application Laid-Open (Kokai) No. 2004-136904 discloses an apparatus in which a plurality of container holding parts that hold bags in a horizontal state are provided at the periphery of an intermittently rotating table; and each time the table halts, manufacturing steps including supplying of a bag, opening of the bag mouth and expanding of the body of the bag, inserting of a spout, sealing, cooling, etc. are sequentially performed at the intermittently halting positions.

In the apparatus shown in Japanese Patent Application Laid-Open (Kokai) No. 2004-136904, bags are intermittently transported along a movement path in a horizontal state; and each time the bag halts, steps including opening of a bag mouth, inserting of a spout, sealing, cooling, etc. are sequentially performed at the intermittently halting positions In the apparatus of Japanese Patent Application Laid-Open (Kokai) No. H5-131573, bags are horizontally carried on a bag carrying stand and intermittently transported; and each time the bag halts, steps including supplying of a bag and spout, opening of the bag mouth, inserting of the spout, sealing of the spout and bag, etc. are sequentially performed at the intermittently halting positions In the apparatuses disclosed in Japanese Patent Application Laid-Open (Kokai) Nos. H10-291509, 2004-136904 and 10-323920, the step of inserting a spout into a bag and the step of sealing the spout and bag are performed at the same halting position. Therefore, such a halting position makes the step that controls the speed, and the problem arises that improving the performance of the apparatus (pieces/minute) is difficult. Also, in Japanese Patent Application Laid-Open (Kokai) No. H10-323920, the many container holding parts are packed in with their many respective mechanisms, so the structure of the container holding part is complicated, causing problems of increased cost and issues regarding cleaning, maintenance, etc.

In Japanese Patent Application Laid-Open (Kokai) No. H5-131573, inserting a spout into a bag mouth is a process of two stages: first the spout is temporarily inserted in a port holder, and then the port holder is moved horizontally and the spout is inserted in the bag mouth. Therefore, the number of steps required increases, and the number of halting positions increases; and in addition, the apparatus itself becomes large size-wise. Also, since the spout is loosely held by the port holder, when the capacity increase is made in the apparatus (for instance, when the working speed of the apparatus is increased), the spout would be displaced in its longitudinal direction. In addition, the fit-in type of port holders for the bag carrying stand need to be provided so as to be able to move horizontally and also need drive mechanisms therefore. Thus, the problem is that the bag carrying stand mechanism is complicated.

BRIEF SUMMARY OF THE INVENTION

The present invention provides a method and apparatus for manufacturing a bag equipped with a spout made to overcome the problems with the prior art.

The object of the present invention is to provide a bag manufacturing method that increases the bag manufacturing performance and at the same time to eliminate unreliability in positioning of the spout(s) inserted in the mouth(s) of a bag (called "bag mouth(s)) and in addition to provide a bag manufacturing apparatus which is more compact and simpler in size and structure.

The above object is accomplished by unique steps of the present invention for a method of manufacturing a bag equipped with at least one spout in which a supplied bag is gripped by bag-gripping members and intermittently transported along a closed (circular) transport path, and its manufacturing steps including inserting of a spout(s) in a bag mouth(s) and sealing of the spout(s) and bag mouth(s) are sequentially performed at intermittently halting positions; and in the present invention, the method comprises the ordered steps of:

- at a spout inserting position,
  - opening the bag mouth(s) by a bag mouth opening means,
  - inserting a spout(s) in the opened bag mouth(s),
  - gripping the spout(s) inserted into the bag mouth(s) by spout gripping members and holding the spout(s) at that position, and
  - inactivating the bag mouth opening means, thus releasing the bag mouth(s), and during this interval the bag body is expanded by a bag body expanding means;
- transporting the bag and spout(s) to a spout/bag mouth sealing position, with the spout(s) being held by the spout gripping members and the bag body being expanded by the bag body expanding means;
- at a spout/bag mouth sealing position,
  - executing sealing (attaching) of the spout(s) and bag mouth(s), and
  - inactivating the bag body expanding means, thus releasing the bag body; and
- transporting the bag with the spout(s) attached thereto to a next halting position.

In this method of the present invention, it is preferable that expansion of the bag body is performed after the opening of the bag mouth(s).

In addition, in the present invention, second and third spout/bag mouth sealing positions can be provided after the above-described spout/bag mouth sealing position.

Furthermore, in the bag manufacturing method of the present invention, the bag-gripping members grip the bag which is in, for example, a horizontal state, and transport the bag in the horizontal state.

In the manufacturing method of the present invention, a bag that has a certain characteristic shape is used. More specifically, the bag is preferably polygonal in shape, the horizontal portion of the top edge of the bag is sealed, and the shoulder portions (called "shoulders") are cut at a slant on both sides thereof, with at least one of such shoulders being unsealed bag mouth(s). The spout(s) is inserted in the bag mouth(s) that is at one of both shoulders at the spout inserting position, and the spout(s) and the bag mouth(s) are sealed at the spout/bag mouth sealing position.

The above-described type of bag includes those in which the portions near both shoulders of the top edge are unsealed in a continuous manner to both shoulders; and for these bags, in the spout inserting position, at least one of the portions including the unsealed portions near both shoulders of the top edge is opened as the bag mouth(s).

In any event, the bag-gripping members grip only the sealed portion at the top edge of the bag.

The above object is further accomplished by a unique structure of the present invention for an apparatus of manufacturing a bag equipped with at least one spout in which a plurality of sets of bag-gripping members for griping a supplied bag are provided at equal spaces with such bag-gripping members being intermittently movable the same distance as the spacing between the sets of bag-gripping members along a closed (circular) movement path defined by a circular table, and in which the manufacturing steps including inserting of spout(s) in the bag spout(s) and sealing of the spout(s) and bag mouth(s), etc. are sequentially performed at halting positions of, for instance, the rotating circular table; and in the present invention, the apparatus includes:

- spout gripping members for gripping spouts and holding the spout(s) at a predetermined position, the spout gripping members being disposed to correspond to the bag-gripping members and moved intermittently together with the bag-gripping members;
- a bag mouth opening means for opening the bag mouth(s) and a spout inserting means for inserting the spout(s) in the bag mouth(s), both means being provided at a spout inserting position where the spouts are inserted in the bag mouths;
- a sealing means provided at a spout/bag mouth sealing position where the spout(s) and the bag mouth(s) are sealed together (or the spout(s) is attached to the bag mouth(s)); and
- a bag body expanding means for expanding the bag body, the bag body expanding means being provided so as to be movable in a reciprocating manner between the spout inserting position and the spout/bag mouth sealing position in accordance with a moving configuration in which the bag body expanding means moves from the spout inserting position to the spout/bag mouth sealing position as the bag-gripping members are moved and then returns to the spout inserting position after the sealing of the spout(s) and bag spout(s) is performed.

In this structure, second and third spout/bag mouth sealing positions can be provided after the above-described spout/bag mouth sealing position.

In the above-described manufacturing apparatus of the present invention, the bag body expanding means comprises, for instance, a pair of suction cups disposed so as to suction both surfaces of the bag. In this structure, the suction cups on one side are disposed to correspond to the bag-gripping members and move intermittently together with the bag-gripping members, and the suction cup on the other side is disposed between the spout inserting position and the spout/bag mouth sealing position so that it can move in a reciprocating manner in accordance with the above-described moving configuration. The suction cups on one side are dedicated to the bag-gripping members and are provided in the same number as the number of the bag-gripping members; and the single suction cup on the other side is shared by (and is used for) all the bag-gripping members.

The above-described manufacturing apparatus of the present invention preferably uses an intermittently rotating table, i.e. one in which bag-gripping members are disposed at equal spacing on the periphery of a table that rotates intermittently on a horizontal plane. The bag is gripped in a horizontal state on the table and transported. The bag body expanding means comprises a pair of upper and lower suction cups disposed so as to suction both (upper and lower) surfaces of the bag; the suction cup on the lower side is disposed on the above-described table so that it corresponds to the bag-gripping members; and the suction cup on the upper side is disposed between the spout inserting position and the spout/bag mouth sealing position so that it moves in a reciprocating manner in the above-described moving configuration.

In the manufacturing apparatus of the present invention, when attaching the spout(s) to at least one of both shoulders of a polygonal bag, it is preferable that the bag-gripping members grip the sealed portion of the top edge of the bag.

In addition, when the manufacturing apparatus is the intermittently rotating table type, it is preferable that the bag be horizontal with the top edge thereof oriented toward the outer peripheral direction of the table, and the bag-gripping members grip the sealed portion of the top edge the bag.

As seen from the above, in the present invention, a supplied bag is gripped by the bag-gripping members and intermittently transported, and several steps to manufacture a bag equipped with spout(s) at halting positions are performed; and the spout inserting position where the spout(s) is inserted in the bag mouth(s) and the spout/bag mouth sealing position where the spout(s) and the bag mouth(s) are sealed are separated. As a result, it is possible in the present invention to speed up the processing speed compared to a case in which the spout insertion and the sealing are performed at the same halting position.

In addition to the separation of the working positions into two, in the present invention, the spout gripping members are provided so as to be near the bag mouth(s) to correspond to the bag-gripping members, and the spout(s) inserted in the bag mouth(s) by the spout insertion means is gripped, so that the spout(s) is positioned at a predetermined position inside the bag mouth(s) while moving from the spout inserting position to the spout/bag mouth sealing position and during the sealing step as well, after the spout insertion means releases the spout(s). With this arrangement, the spout gripping members grip the spout(s) inserted in the bag mouth(s) and hold it securely at those positions; furthermore, since the spout gripping members simply hold the spout(s) at those positions and do not move the spout positions, spout positioning and holding can be accomplished with an extremely simple mechanism, and the number of steps does not increase greatly.

Furthermore, in the present invention, the body of the bag (called "bag body") is expanded by the bag body expanding means at the spout inserting position, and the bag is transported in that state to the spout/bag mouth sealing position, and then the spout(s) and the bag mouth(s) are sealed together there. By way of expanding the body of the bag to essentially about the opening width of the bag mouth(s), positional displacement and the like of the bag mouth(s) in relation to the spout(s) caused by bending or curvature of the bag surface is prevented.

In addition, the bag body expanding means is provided so that it reciprocates or is moved in a reciprocating fashion in the above-described moving configuration between the spout inserting position and the spout/bag mouth sealing position. Accordingly, it is possible to expand all of the bag bodies simply by providing a single bag body expanding means, and thus the apparatus can have a simplified and compact structure.

Furthermore, the bag body expanding means comprises a pair of suction cups disposed so as to suction both (upper and lower) surfaces of the bag; and the suction cups on one (first) side are provided in a plurality of numbers to correspond to the bag-gripping members, and the suction cup on the other (second) side is provided so as to be movable in a reciprocating fashion in the above-described moving configuration between the spout inserting position and the spout/bag mouth sealing position. In this structure, the suction cup of the other (second) side is provided as a single shared cup that can be used commonly to the suction cups on one (first) side, and thus, the structure of the apparatus is simple.

In the present invention, a polygonal bag that has shoulders cut at a slant on both sides of the sealed top edge of the bag with at least one of the shoulders making the unsealed bag mouth(s) can be used. For this bag, when the top edge of the bag is held by the bag-gripping members, a reliable positioning and holding of the bag at its very near the bag mouths on both sides is accomplished. As a result, it is possible to prevent positional displacement of the bag mouth (s) when opening the bag mouth(s) with the bag mouth opening means or when expanding the bag body with the bag body expanding means between the spout inserting position and the spout/bag mouth sealing position or when the sealing is performed on the bag and spout(s).

The portions near both shoulders of the top edge of the above-described bag are unsealed in a continuous manner to both shoulders, and at the spout inserting position at least one of the portions including such unsealed portions is opened as the bag mouth(s); accordingly, the bag can be opened in a larger size than the formed mouth(s) is opened, and insertion of even a large-size spout(s) becomes easy.

DETAILED DESCRIPTION OF THE INVENTION

Below, the present invention will be described in detail with reference to FIGS. 1 through 8.

Figure 1:
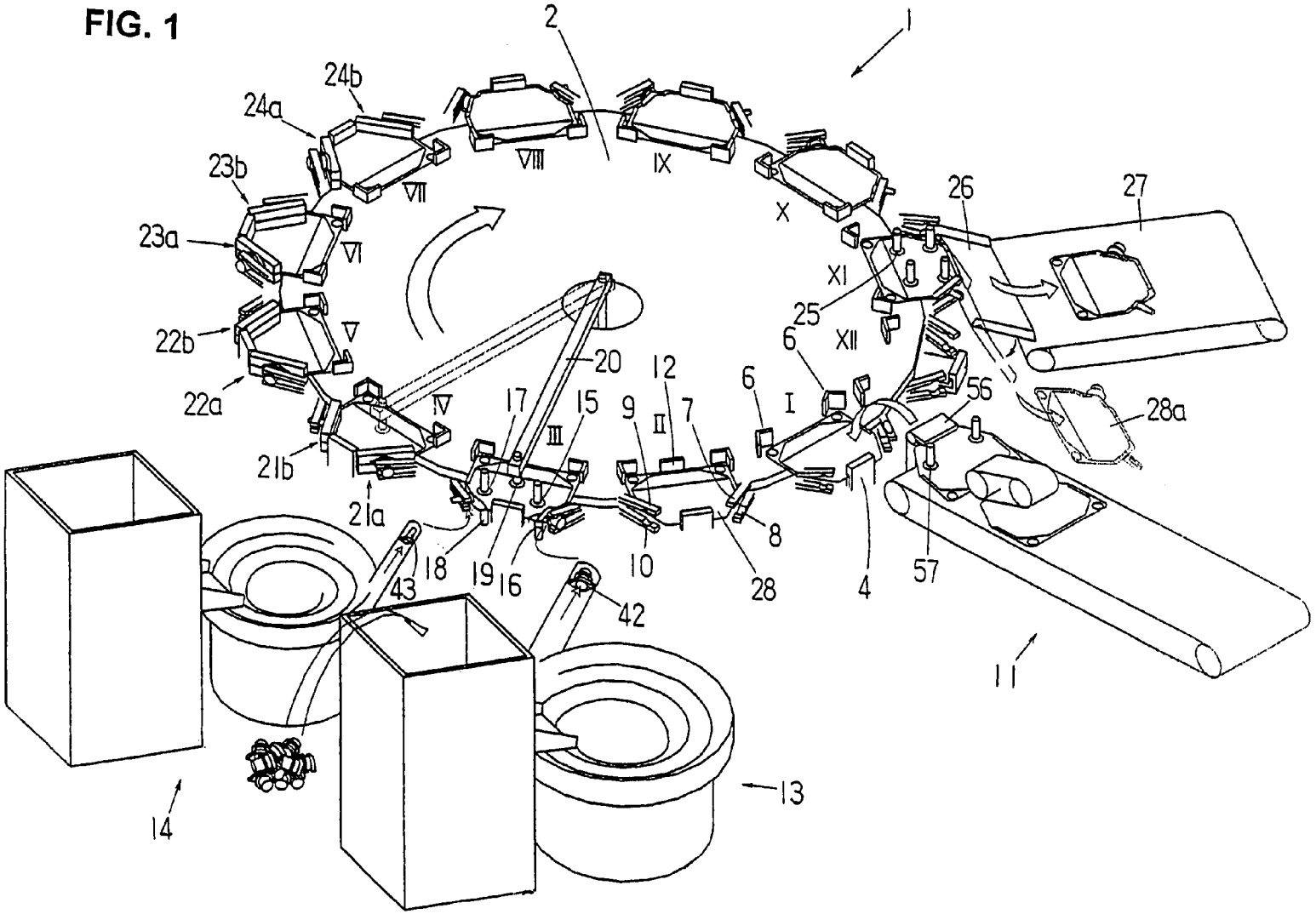
FIG. 1 is an overall perspective view of an apparatus for manufacturing a bag equipped with spouts according to the present invention.

The apparatus for manufacturing a bag equipped with at least one spout is, as seen from FIG. 1, comprised of an intermittently rotating table-type spout inserting and sealing apparatus 1 and various devices that are provided at locations corresponding to the halting positions of the intermittently rotating table-type spout inserting and sealing apparatus 1.

The spout inserting and sealing apparatus 1 includes a table 2 that rotates intermittently and a bag-gripping device 3 (only an upper bag-gripping member 4 thereof is shown) that is disposed at each of the twelve (12) locations on the periphery of the table 2. A bag positioning device 5 (only bag positioning members 6 thereof is shown) and spout gripping members 7-10 that correspond to each bag-gripping device 3 are provided on the table 2.

The table 2 halts twelve (12) times in the course of one rotation. The steps for manufacturing a bag equipped with spouts are sequentially performed at the halting positions.

In the structure of FIG. 1, a conveyor magazine-type bag supply device 11 is disposed at halting position I, and a bag positioning device (only a pusher 12 thereof is shown) is disposed at halting position II.

Disposed near halting position III are spout supply devices 13 and 14, bag mouth opening devices (only suction cups 15-18 thereof are shown as bag mouth opening means), and a bag body expanding device (only its suction cup 19, which is one of the bag body expanding means, and a suction cup arm 20 are shown).

Sealing devices (only heating plate pairs 21*a* and 21*b* through 23*a* and 23*b* thereof are shown as sealing means) are disposed at halting positions IV-VI At the next halting position VII, cooling devices (only cooling plate pairs 24*a* and 24*b* thereof are shown as cooling means) are disposed.

Disposed at halting positions VIII-X are detecting devices (not shown in the drawing).

A product extraction device (only a suction cup 25 is shown), a vibrating-type product extraction chute 26, and a product transport conveyor 27 are disposed at halting position XI.

Halting position XII is an idle position.

Though not shown in FIG. 1, pushers for operating the spout gripping members 7-10 are provided at halting positions III and XI, and a pusher that makes the gripping member 4 slant greatly outward is provided at halting position XI.

Figure 2:
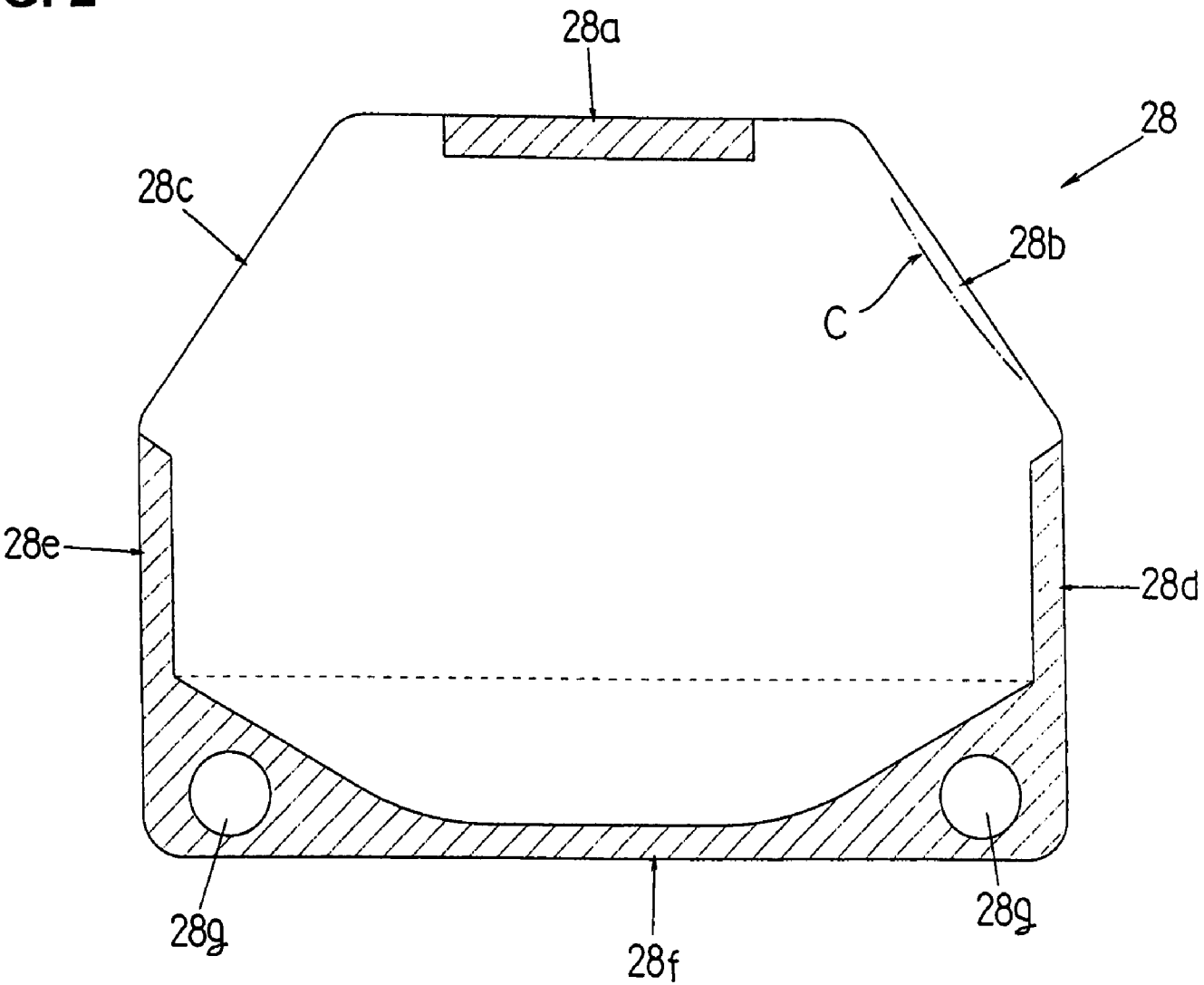
FIG. 2 is a top view of a bag to be supplied to the apparatus of FIG. 1.

FIG. 2 shows a bag 28 as raw material. Overall, the bag 28 is polygonal in shape. The top edge 28*a* is horizontal (or straight), and shoulders 28*b* and 28*c* are cut at a slant on both sides thereof. The two parallel side edges 28*d* and 28*e* are vertical, and a bottom edge 28*f* is horizontal (or straight). Holes 28*g* are formed along the bottom edge 28*f* so that the bag can be suspended via the holes 28*g* upside down when, for example, in use. The sealed portions are shown by slanted lines. The portions near both shoulders 28*b* and 28*c* and the top edge 28*a* are unsealed, and these areas will be the bag mouth(s) where various differently shaped spout(s) is sealed or attached.

Figure 4:
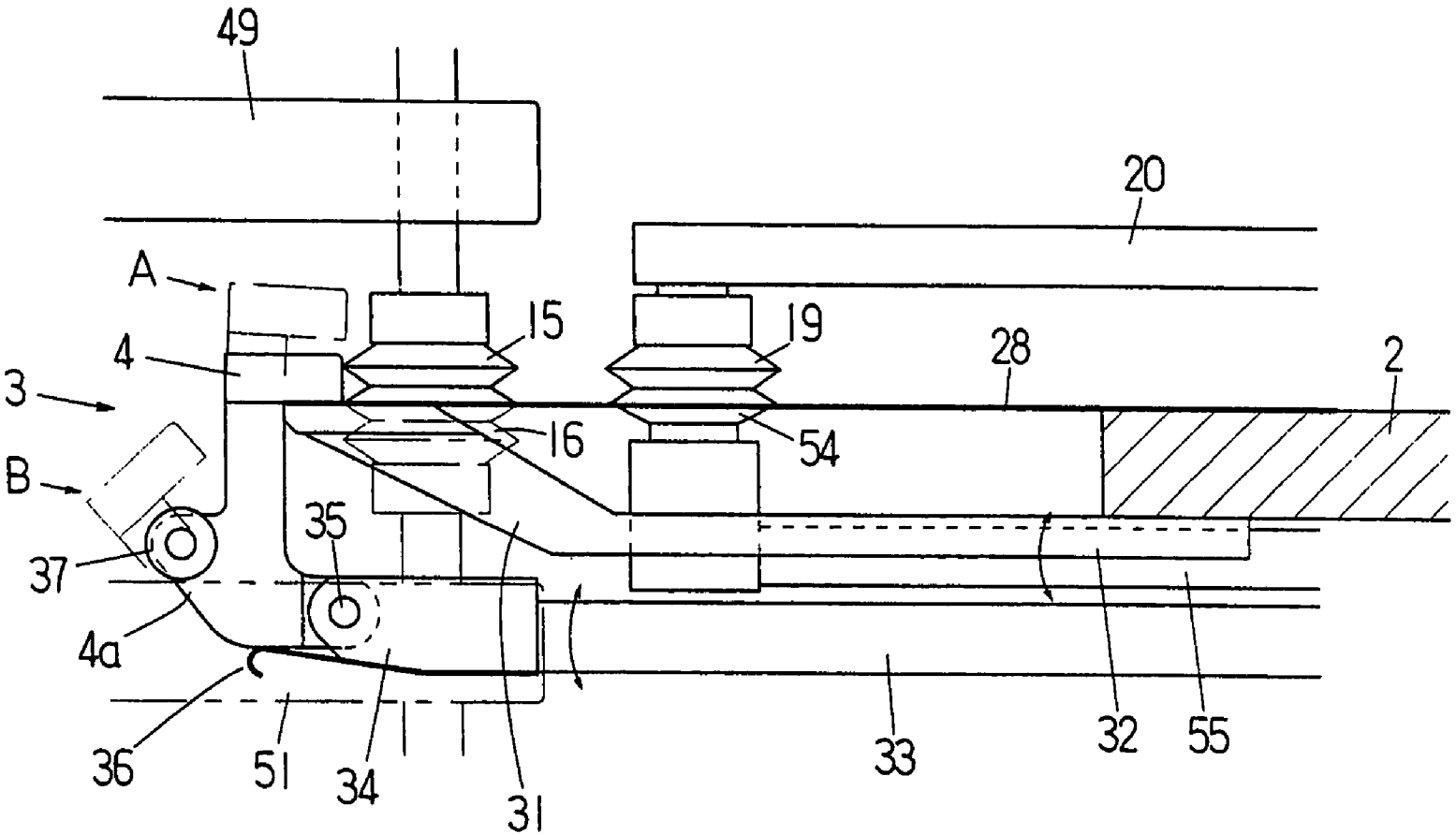
FIG. 4 is a side view of the bag-gripping device used in the bag manufacturing apparatus of the present invention and its vicinity (before opening of the bag mouth and expanding of the bag body are performed)

The bag-gripping device 3, as shown in FIG. 4 in particular, comprises an upper bag-gripping member 4 and a lower bag-gripping member 31. The lower bag-gripping member 31 is integrally formed at the tip-end of a fixed arm 32 that is fixed to the lower surface of the table 2 so that it is oriented in the radial direction of the table 2; and the upper surface of the gripping part of the lower bag-gripping member 31 is formed as a plane (or is flat) so that it carries the bag 28 thereon.

The upper bag-gripping member 4 is moveable. The lower surface of the gripping part of the upper bag-gripping member 4 is formed as a plane, and a bag is gripped between this flat griping part of the upper bag-gripping member 4 and the flat gripping part of the lower bag-gripping member 31. A bag-gripping arm 33 is radially oriented under the table 2 and is supported at the lower surface of the table 2 so that it can oscillate vertically (the oscillation direction being indicated by an arrow in FIG. 4). The upper bag-gripping member 4 is pivotally supported (on a support shaft 35) at a bearing 34 which is at the tip-end of the bag-gripping arm 33 so that it can oscillate on a perpendicular plane passing through the rotational center of the table 2. The upper bag-gripping member 4 is urged toward the table 2 side by a flat spring 36 fixed to the bearing 34, and it is anchored by an anchor member not shown in the drawing so that it does not fall toward the table 2 side further than a substantially perpendicular state (the perpendicular state being indicated by the solid line in FIG. 4). Also, a projection 4*a* is formed on the outer peripheral side of the table 2, and a roller 37 is attached to the projection 4*a*.

In FIG. 4, when the bag-gripping arm 33 is driven by a drive source such as a cam, etc. (not shown in the drawing) and moved upward, the upper bag-gripping member 4 rises to the position of imaginary line A and makes a gap with the lower bag-gripping member 31, so that the bag 28 is inserted in between. On the other hand, when the bag-gripping arm 33 is moved downward, the upper bag-gripping member 4 descends to the solid line position and grips the bag 28 between it and the lower bag-gripping member 31. When the roller 37 is pushed down by a pusher (not shown in the drawing) from the state shown by imaginary line A against the tension force of the flat spring 36, the upper bag-gripping member 4 slants greatly outward as indicated by imaginary line B, and the bag 28 can be removed in the radial direction of the table 2.

Figure 3:
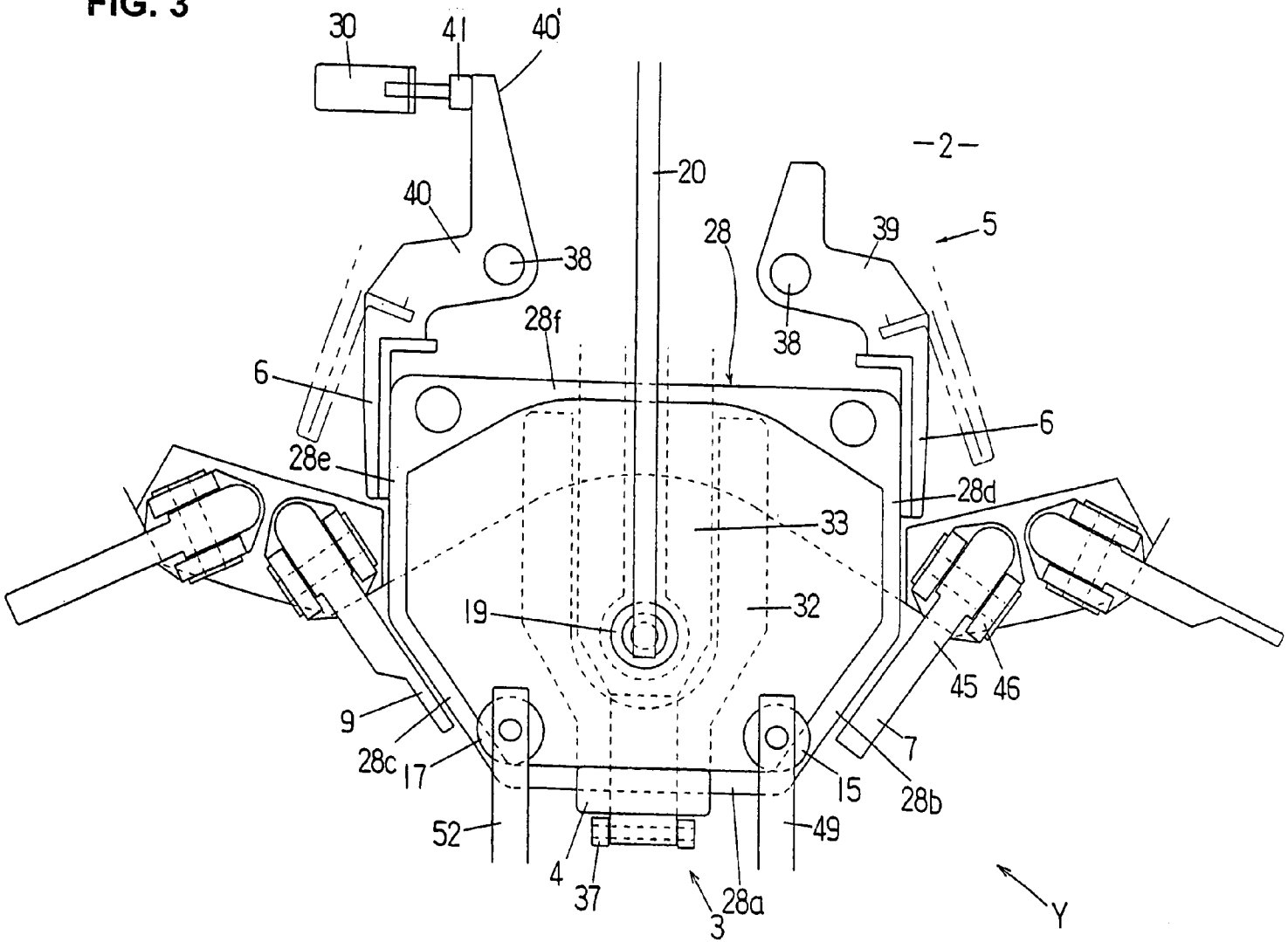
FIG. 3 is a top view (before spouts insertion is performed) of the essential portion of the apparatus of FIG. 1 at halting position III (the spout inserting position)

The bag positioning device 5 (only bag positioning members 6 thereof is shown in FIG. 1) centrally positions the bag 28 in the lateral direction. As shown in FIG. 3, the bag positioning device 5 comprises a pair of positioning members 6 and 6 that operate symmetrically. More specifically, the bag positioning members 6 and 6 are integrally formed at the tip-ends of levers 39 and 40, which are supported on swinging lever shafts 38 (fixed to the table 2) so that they can swing freely. The bag positioning device 5 further includes a linking mechanism (not shown in the drawing) that links and symmetrically operates the positioning members 6 and 6, a drive source such as a cam, etc., and a stopper 41 that regulates the oscillation end 40' of the positioning members 6 and 6. The positioning members 6 and 6 are installed so that when they are driven by the drive source and oscillate in the direction shown by solid-line and the rear end 40' of the one lever 40 makes contact with the stopper 41 and halts, then they precisely touch with the side edges 28*d* and 28*e* of the bag 28. The position of the stopper 41 can be regulated by, for example, a spring with respect to an attachment member 30 fixed to the table 2.

The spout gripping members 7-10 grip spouts 42 and 43 (see FIG. 1) from above and below. As to the one set of the spout gripping members 7 and 8, as seen from FIG. 6, the lower spout gripping member 8 is integrally formed at the tip-end of an spout gripping arm 44 fixed to a recessed surface on the top of the table 2. The upper spout gripping member 7 is integrally formed at the tip-end of an spout gripping arm 45, and the spout gripping arm 45 is fixed to a swinging lever shaft 47 swigably supported by a bearing 46 fixed to the spout gripping arm 44. The spout gripping arm 45 can oscillate freely and vertically about the swinging lever shaft 47, and it is urged in the closed direction (a direction in which the gripping member 7 is moved downward in FIG. 6) by a compression spring 48 interposed between the rear ends of the spout gripping arms 45 and 44. To open the spout gripping members 7 and 8, the rear end of the spout gripping arm 45 is pressed from above by the previously described pusher and pushed down (only the spout gripping member 7 moves). Conversely, the spout gripping arm 45 on front of the swinging lever shaft 47 side can be pushed upward from below by the pusher.

The other spout gripping members 9 and 10 have basically the same structure as described above for the spout gripping members 7 and 8, except that they are used for spouts of different diameters from the spouts which the spout gripping members 7 and 8 grip.

The spout gripping members 7 and 8 are disposed so that they are parallel to the shoulder 28*b* of the bag 28 when the bag 28 is positioned on the table 2, and the center axis of the spout 42 is set to be perpendicular to the shoulder 28*b*. On the other hand, the spout gripping members 9 and 10 are disposed so that they are parallel to the shoulder 28*c* of the bag, and the center axis of the spout 43 is set be perpendicular to the shoulder 28*c*.

The bag mouth opening device is disposed at halting position III as shown in FIG. 1, and it has suction cups 15-18 as bag mouth opening means. The suction cups 15 and 16 open the bag mouth on the shoulder 28*b* side of the bag 28, and the suction cups 17 and 18 open the bag mouth on the shoulder 28*c* side.

Figure 5:
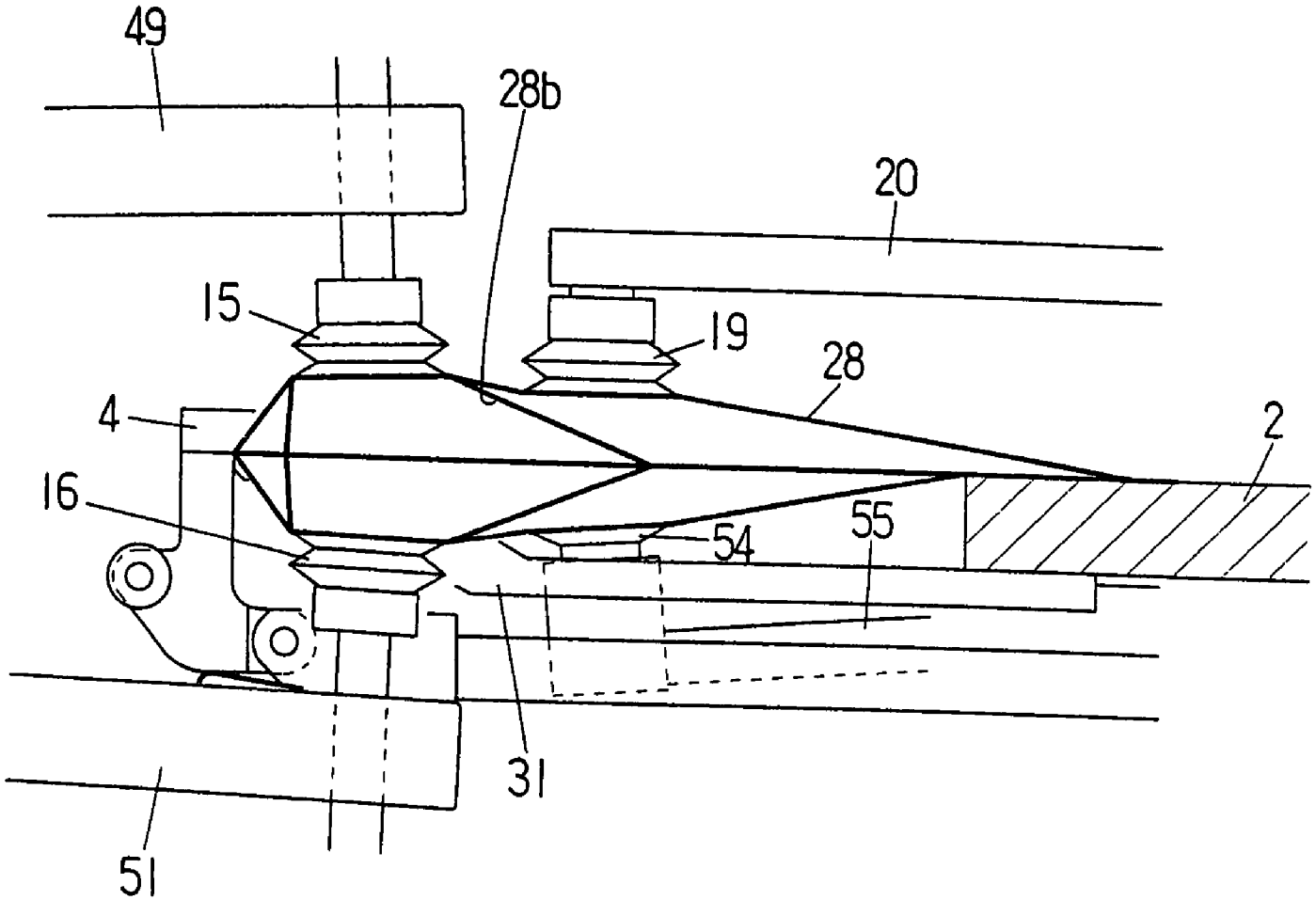
FIG. 5 is a side view of the bag-gripping device and its vicinity (after opening of the bag mouth and expanding of the bag body are performed)
Figure 6:
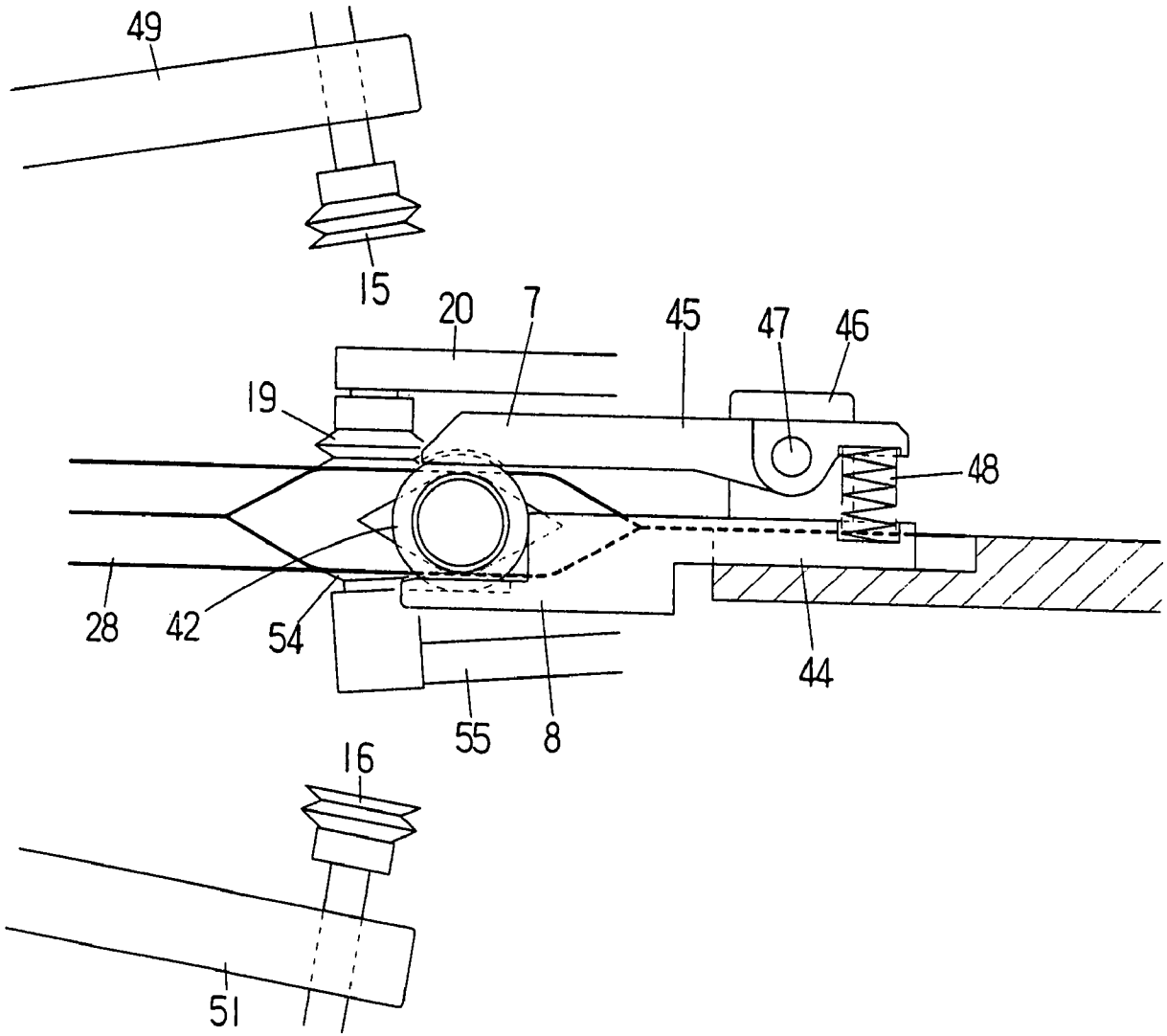
FIG. 6 is a side view seen in the direction of arrow Y in FIG. 3 (after spouts insertion is performed)

As seen from FIGS. 4-6, the suction cup 15 is provided at the tip-end of a suction cup arm 49 that oscillates vertically, and the suction cup 16 is provided at the tip-end of a suction cup arm 51 that oscillates vertically and symmetrically with the suction cup arm 49. These suction cups 15 and 16 communicate with a shared vacuum pump through pipes, which are installed inside the respective suction cup arms 49 and 51, via changeover valves and filters (not shown in the drawing). The suction cups 17 and 18 are likewise provided on the arms (only a suction cup an arm 52 is shown in FIG. 3) and have the same basic structure as the suction cups 15 and 16.

As shown in FIG. 4, the suction cup arms 49 and 51 are driven by a drive source (not shown in the drawing), and suction cups 15 and 16 on these cup arms 49 and 51 approach one another; and when they communicate with the vacuum pump, they suction the bag surface near the bag mouth on the shoulder 28*b* of the bag 28 from above and below. When the suction cup arms 15 and 16 which are thus suction-holding the bag surface near the bag mouth of the shoulder 28*b* of the bag 28 are driven in reverse and the suction cups 15 and 16 become distanced from one another, the bag mouth of the shoulder 28*b* opens as shown in FIG. 5. When communication with the vacuum pump is blocked and air is introduced into the suction cups 15 and 16, the suction cup arms 49 and 51 then oscillate farther and separate from the bag 28 as shown in FIG. 6. The suction cups 17 and 18 operate in the same manner at the same time as the suction cups 15 and 16 and open the bag mouth on the shoulder 28*c* of the bag 28.

The bag body expanding device disposed near halting position III is comprised of an upper bag body expanding means and a lower bag body expanding means.

The upper bag body expanding means is the suction cup 19 previously described, which communicates, via changeover valves and filters (not shown in the drawing), with a vacuum pump through a pipe installed inside the suction cup arm 20. The suction cup arm 20 can be raised and lowered by a drive source such as a cam (not shown in the drawing), and it also swings in sync with the intermittent rotation of the table 2. The suction cup arm 20 is moved to follow the intermittent rotation of the table 2 as shown by dotted lines in FIG. 1, and then it swings back to its original position as shown by solid lines in FIG. 1. The suction cup 19 is raised and lowered upon the rising and lowering motions of the suction cup arm 20, and it makes reciprocating (swinging) movement between the halting position III and the next halting position IV according to the forward and return swing motions of the suction cup arm 20.

The lower bag body expanding means of the bag body expanding device is a suction cup 54 as shown in FIG. 4. A suction cup arm 55 is oriented in the radial direction of the table 2 beneath it and is supported on the lower surface of the table 2 so that the suction cup arm 55 can oscillate vertically (the oscillation direction of the suction cup arm 55 is shown by the arrow in FIG. 4). The suction cup 54 is disposed at the tip end of the suction cup suction cup arm 55. A vacuum pipe is provided inside the suction cup arm 55, and the suction cup 54 communicates, via changeover valves and filters (not shown in the drawing), with the shared vacuum pump by this pipe installed in the suction cup arm 55. It goes without saying that sets comprising the suction cup 54 and suction cup arm 55 are provided to correspond to each gripping member 4 and 31 (in other words, twelve (12) sets of the suction cup 54 and suction cup arm 55 are provided).

As seen from FIG. 4, when the suction cup arm 20 descends and the suction cup arm 55 is driven by a drive source such as a cam (not shown in the drawing) and is moved upward, the suction cups 19 and 54 suction the body of the bag 28 from above and below. When the suction cup arm 20 rises and the suction cup arm 55 is moved downward, the body of the bag 28 is expanded as shown in FIG. 5.

The pusher 12 of the bag positioning device is, as seen from FIG. 1, provided at the halting position II. The pusher 12 is located on the top of the table 2. It pushes the bottom edge 28*f* of the bag 28, for which a lateral positioning has been made by the positioning member 6 of the bag positioning device 5, rises and touches the inside surface of the upper bag-gripping member 4 at imaginary line A position (FIG. 4), and then positions it vertically (in the radial direction of the table 2).

The conveyor magazine-type bag supply device 11 disposed at halting position I transports stacked and staggered bags in such a manner that the bag mouths are aimed forward and the underlying bags are to the rear, and further, the leading bag is separated, one by one, and is transported forward. As shown in FIG. 1, a reversing-type supply device 56 (only its grip part is shown) is provided at the front of the conveyor magazine-type bag supply device 11, so that it grips near the top edge 28*a* of the bag 28 lifted by a suction cup 57, reverses the bag 180°, and then supplies the bag 28 to the table 2. As seen from FIGS. 3 and 4, the bottom edge 28*f* side of the bag 28 supplied to the table 2 is carried on the upper surface of the table 2, and the top edge 28*a* side is carried on the upper surface of the grip part of the lower grip member 31.

As shown in FIG. 1, the spout supply devices 13 and 14 insert spouts 42 and 43, one by one, into the corresponding bag mouths (the shoulder 28*b* side and the shoulder 28*c* side) of the bag 28, which is halted at halting position III and whose bag mouths have been opened. The spout supply devices 13 and 14 respectively comprise a so-called parts feeder and a spout inserting means that receives the spouts 42 and 43 one by one from the parts feeder, holds them, transports them to the predetermined position, and inserts them in the bag mouths.

The spout 42, transported by one of the spout inserting means to the above-described predetermined position, is gripped by the spout gripping members 7 and 8; and the spout 43 transported by the other spout inserting means is gripped by the spout gripping members 9 and 10. When the spouts 42 and 43 are gripped by the spout gripping members 7-10, the spout inserting means releases the spouts 42 and 43 and returns to its original position.

Next, the operation of the apparatus for manufacturing a bag equipped with spouts described above will be described below.

(1) At halting position I, the leading (first) bag 28 on the conveyor magazine-type bag supply device 11 is gripped by the reversing-type supply device 56, reversed 180°, and supplied to a predetermined position on the table 2. At this time, the upper bag-gripping member 4 is in a state where it has descended to the solid-line position shown in FIG. 4, and the positioning members 6 and 6 of the bag positioning device 5 are in their open state. The bag 28 is carried on the table 2 and gripping part of the lower bag-gripping member 31.

(2) The table 2 rotates; and while the bag 28 is moved from halting position I to halting position II, the positioning members 6 and 6 of the bag positioning device 5 oscillate toward the inner side and position the bag 28 so that the bag 28 is laterally centered. The positioning members 6 and 6 subsequently maintain this bag centering state until they pass halting position X.

(3) At halting position II, the upper bag-gripping member 4 is raised to the position of imaginary line A shown in FIG. 4, and then the pusher 12 provided at halting position II pushes the bag 28 outward in the radial direction of the table 2, so that the bag touches the upper bag-gripping member 4 and is positioned vertically (in the vertical direction of the bag 28).

Next, the upper bag-gripping member 4 is lowered (see the solid line in FIG. 4) and grips the sealed portion of the top edge 28*a* of the bag 28 between the upper bag-gripping member 4 and the lower bag-gripping member 31. The upper bag-gripping member 4 subsequently remains at this descended position until it passes halting position X.

(4) At halting position III, the spout gripping members 7 and 8 and 9 and 10 are opened by pushers disposed at halting position III, and the suction cups 15 and 16 of the bag mouth opening device provided at halting position III open the bag mouths on the shoulder 28*b* side of the bag 28, and at the same time the suction cups 17 and 18 open the bag mouths on the shoulder 28*c* side.

Next, the suction cup 19 of the bag body expanding device that returned to halting position III and the suction cup 54 provided on the lower surface of the table 2 work together to expand the body of the bag 28 (bag body). Expanding of the body of the bag 28 is performed a little after the opening of the bag mouths. This is because it is difficult to allow the air to flow into the bag interior if the bag mouths are not opened, making the expanding of the bag body difficult. The delay of expanding of the body of the bag 28 is also for the purpose of waiting for the suction cup arm 20 and suction cup 19 to return to the halting position III.

The spout inserting means of the spout insertion device 13 next inserts the spout 42 in the bag mouth on the shoulder 28*b* side of the bag 28, and the spout inserting means of the spout insertion device 14 inserts the spout 43 in the bag mouth on the shoulder 28*c* side.

Then, the above-described pushers retract and the spout gripping members 7-10 close and grip the spouts 42 and 43.

Next, the spout inserting means release the spouts 42 and 43. Also, air is introduced into the suction cups 15-18, and the suction cups 15-18 are moved vertically and separated from the bag 28.

(5) The table 2 rotates; and when the bag 28 is moved from halting position III to halting position IV, the suction cup arm 20 and suction cup 19 of the bag body expanding device swing in sync with the table 2 to follow the rotation of the table 2. The lower suction cup 54 is provided on the table 2 and thus moved together with the table 2; accordingly, the body of the bag 28 is suctioned by the suction cups 19 and 54 and arrives at halting position IV in an expanded state.

(6) At halting position IV, the heating plates 21*a* seal (attach) the spout 42 to the shoulder 28*b* of the bag 28 and seals the unsealed portions of the shoulder 28*b* and top edge 28*a*. The heating plates 21*b* seal (attach) the spout 43 to the shoulder 28*c* of the bag 28 and seals the unsealed portions of the shoulder 28*c* and the top edge 28*a*.

Next, the heating plates 21*a* and 21*b* are opened, and air is introduced into the suction cups 19 and 54, thus releasing the bag 28, and the suction cup arm 20 and the suction cup 19 rise and swing back to halting position III.

Figure 7:
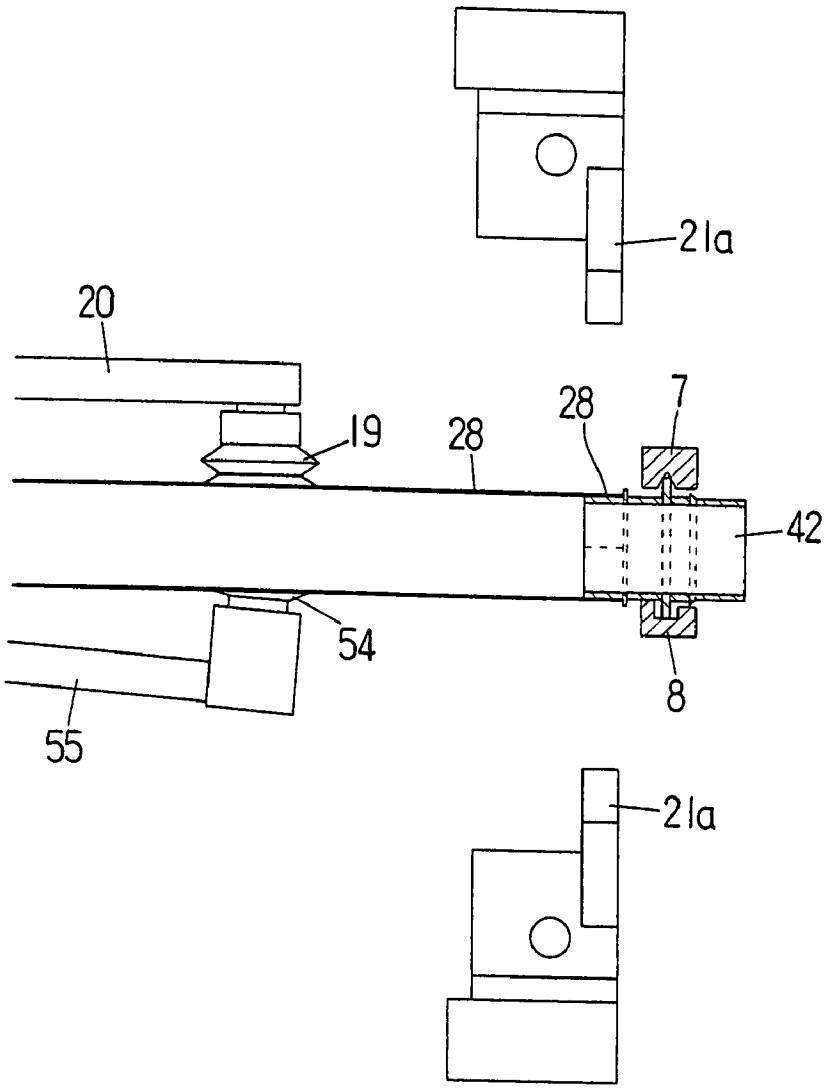
FIG. 7 is a partial cross-sectional side view at halting position IV (which is for a sealing step)
Figure 8:
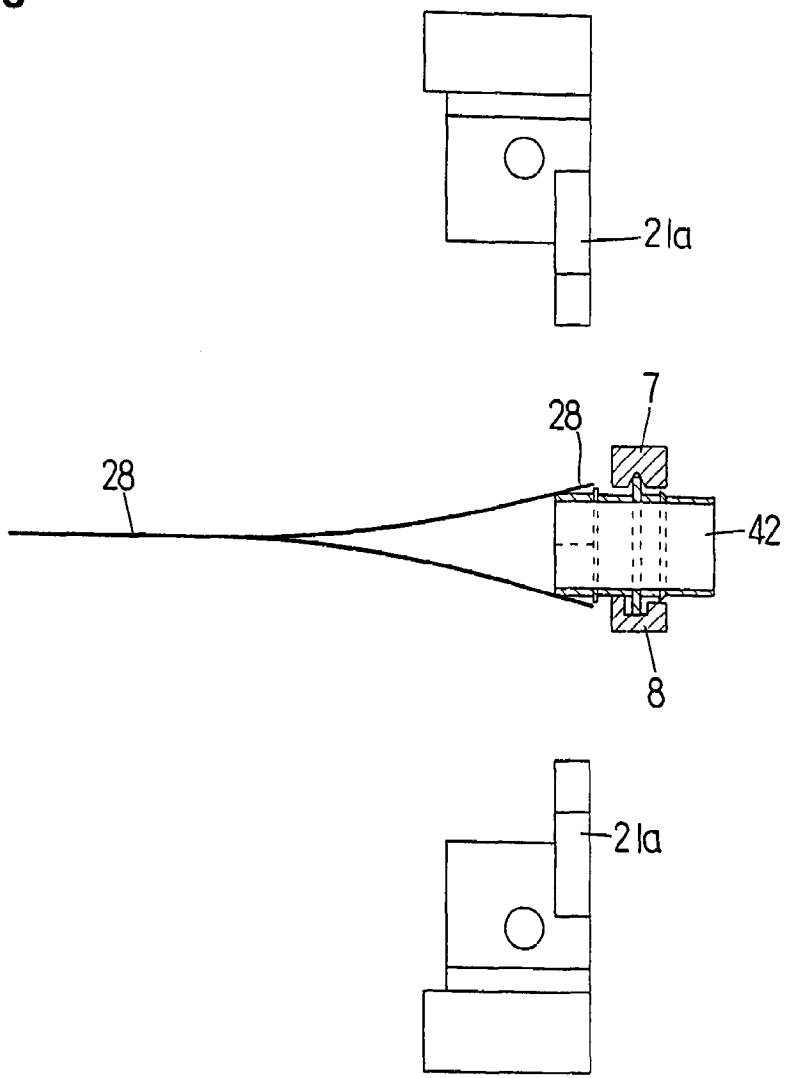
FIG. 8 is the same partial cross-sectional side view as FIG. 7, showing the bag body not expanded.

FIG. 7 shows the state at halting position IV before sealing the spout 42 and bag mouth on the shoulder 28*b* side. At this halting position IV, the body of the bag 28 has been expanded to a thickness that is essentially about the same as the diameter of the spout 42. Therefore, there is no positional displacement of the spout 42 and the bag mouth, and the line of the shoulder 28*b* of the bag is sealed straightly. On the other hand, if the body of the bag 28 were not expanded, as shown in FIG. 8, the bag surface of the bag 28 would curve or bend and widens sharply at the position near the bag mouth where the spout 42 was inserted, causing some positional displacement between the spout 42 and the tip-end of the bag mouth of the bag 28, and greatly curving (the line of) the shoulder 28*b* of the bag to the inside after sealing (imaginary line C in FIG. 2 shows (the line of) the shoulder 28*b* if warping occurred in the bag).

(7) Next, at halting position V, a second sealing is performed by heating plates 22*a* and 22*b*, a third sealing is performed by heating plates 23*a* and 23*b* at halting position VI, and a cooling sealing is further performed at halting position VII by cooling plates 24*a* and 24*b*. Additionally, various inspection processes are carried out at halting positions VIII-X.

(8) While the bag 28 is transported by the rotating table 2 from halting position X to halting position XI, the positioning members 6 and 6 of the positioning device 5 are moved to open outward, the upper bag-gripping member 4 rises (see imaginary line A in FIG. 4), and then the bag 28 is, as a result, released.

(9) At halting position XI, the spout gripping members 7 and 8 and 9 and 10 are opened by pushers provided at this halting position XI; and the roller 37 of the upper bag-gripping member 4 is pushed down by a pusher, and the upper bag-gripping member 4 slants greatly outward (see imaginary line B in FIG. 4).

Then, the suction cup 25 of the product extraction device descends and suctions the bag 28 (that is equipped with the spouts), transports it essentially horizontally to the product extraction chute 26, and releases it there. The bag 28 (a bag equipped with spouts) falls from the product extraction chute 26 onto a product transport conveyor 27 and is transported to outside the apparatus. When the bag 28 (a bag equipped with spouts) is removed from the table 2, the above-described pushers retract, closing the spout gripping members 7 and 8 and 9 and 10, the pusher that pushed the roller 37 downward retracts, and the upper bag-gripping member 4 is returned to its original raised position (see imaginary line A in FIG. 4) by the tension force of the flat spring 36.

If a defect(s) is detected in the bag 28 (that is equipped with the spouts) in the above-described inspection process, the product extraction chute 26 is moved downward as shown by the arrow and by imaginary lines in FIG. 1, and the defective bag (indicated by 28A) falls into a separately disposed container (not shown in the drawing) and not onto the product transport conveyor 27.

(10) While the table rotates from halting position XI to halting position XII, the upper bag-gripping member 4 descends to the position indicated by the solid line in FIG. 4.

(11) Halting position XII is an idle position; and the steps described above are subsequently repeated as the table 2 rotates.

As seen from the above, the present invention is describe with reference to a bag that is formed with two bag mouths at the shoulders. However, the present invention is applicable to a bag that has only one bag mouth so that a single spout is sealed or attached to this single mouth bag. When a single spout is attached to a bag having a single mouth, only the spout gripping members 7 and 8 and the one-side sealing device (the heating plates 21*a*) are used with the bag mouth opening devices (the suction cups 15 and 16) and the spout supply device 13 or instead only the spout gripping members 9 and 10 and the other-side sealing device (the heating plates 21*b*) are used with the bag mouth opening devices (the suction cups 17 and 18) and the spout supply device 14.

The invention claimed is:

1. A method of manufacturing a bag equipped with at least one spout, in which a supplied bag is gripped by bag-gripping members and intermittently transported along a closed transport path, and manufacturing steps including inserting of a spout in a bag mouth and sealing of the spout and bag mouth are sequentially performed at intermittently different halting positions, said method of manufacturing a bag equipped with a spout comprising the ordered steps of:

at a spout inserting halting position, opening at least one bag mouth by a bag mouth opening means, inserting said spout in opened bag mouth, gripping the spout, which is inserted into the bag mouth, by spout gripping members and holding the spout at said spout inserting halting position, and inactivating said bag mouth opening means, thus releasing the bag mouth , and during that interval expanding a bag body by a bag body expanding means;

transporting the bag and spout to a spout/bag mouth sealing halting position, with the spout being held by said spout gripping members and the bag body being expanded by said bag body expanding means;

at the spout/bag mouth sealing halting position, executing sealing of the spout and bag mouth, and inactivating the bag body expanding means, thus releasing the bag body; and transporting the bag to a next halting position.

2. The method of manufacturing a bag equipped with at least one spout according to claim 1, wherein said bag-gripping members grip said bag which is in a horizontal state, and said bag is transported in a horizontal state.

3. The method of manufacturing a bag equipped with at least one spout according to claim 1 or 2, wherein the bag is polygonal, a horizontal portion of a top edge of the bag is sealed, and shoulders on both sides of the sealed horizontal portion are cut at a slant, with the shoulders being unsealed bag mouths;

said bag-gripping members grip the sealed horizontal portion of the top edge of the bag;

respective spouts are inserted in the bag mouths that are on both shoulders at the spout inserting position; and spouts and bag mouths are sealed together at the spout sealing position.

4. The method of manufacturing a bag equipped with at least one spout according to claim 3, wherein portions near both shoulders of top edge of the bag are unsealed in a continuous manner to the shoulders;

said bag-gripping members grip only the sealed horizontal portion of the top edge of the bag; and at the spout inserting position, portions including the unsealed portions near both shoulders of the top edge of the bag are opened as the bag mouths.

5. An apparatus for manufacturing a bag equipped with at least one spout in which bag-gripping members that grip a supplied bag are disposed in a plurality of equally spaced groups, said bag-gripping members being intermittently moved a same distance as a spacing of said spaced group along a closed movement path, and manufacturing steps including inserting of a spout in a bag mouth, and sealing of the spout and bag mouth are sequentially performed at intermittently different halting positions; said apparatus comprising:

spout gripping members for gripping at least one spout and holding the spout at a predetermined halting position, said spout gripping members being disposed to correspond to said bag-gripping members and moved intermittently together with said bag-gripping members;

a bag mouth opening means for opening at least one mouth and a spout inserting means for inserting the spout in the bag mouth, both means being provided at a spout inserting halting position where the spout is inserted in the bag mouth;

a sealing means provided at a spout/bag mouth sealing halting position where the spout and the bag mouth are sealed together; and a bag body expanding means for expanding the bag body, said bag body expanding means being provided so as to be movable in a reciprocating manner between said spout inserting halting position and said spout/bag mouth sealing halting position in accordance with a moving configuration that said bag body expanding means moves from said spout inserting halting position to said spout/bag mouth sealing halting position in accordance with a movement of said bag-gripping members and then returns to said spout inserting halting position after sealing of the spout and bag mouth is performed.

6. The apparatus for manufacturing a bag equipped with at least one spout according to claim 5, wherein said bag body expanding means comprises a pair of suction cups disposed so as to suction both surfaces of the bag;

one of said suction cups is disposed to correspond to said bag-gripping members and moves intermittently together with said bag-gripping members; and another of said suction cups is provided so as to be movable in a reciprocating maimer between said spout inserting halting position and said spout/bag mouth sealing halting position in accordance with said moving configuration.

7. The apparatus for manufacturing a bag equipped with at least one spout according to claim 5, wherein said bag-gripping members are disposed at equal spacing on a periphery of a table, which rotates intermittently on a horizontal plane, and grip the bag in a horizontal state;

said spout gripping member is provided on said table;

said bag body expanding means comprises a pair of upper and lower suction cups disposed so as to suction both surfaces of the bag, said the lower suction cup being provided on said table to correspond to said bag-gripping members, and said upper suction cup being provided so as to be movable in a reciprocating manner between said spout inserting halting position and said spout/bag mouth sealing halting position in accordance with said moving configuration.

8. The apparatus for manufacturing a bag equipped with at least one spout according to claim 7, wherein the bag is polygonal, a horizontal portion of a top edge of the bag is sealed, and shoulders on both sides of the sealed horizontal portion are cut at a slant, with the shoulders being unsealed bag mouths;

said bag-gripping members grip sealed horizontal portion of the top edge of the bag; and said spout gripping members, bag mouth opening means, spout inserting means, and sealing means are provided to correspond respectively to both bag mouths.

9. The apparatus for manufacturing a bag equipped with at least one spout according to claim 8, wherein portions near both shoulders of the top edge of the bag are unsealed in a continuous manner to both shoulders; and said bag-gripping members grip only the sealed portions of the top edge of the bag.

10. The apparatus for manufacturing a bag equipped with at least one spout according to claim 8 or 9, wherein the top edge of the bag is oriented toward an outer diameter direction of said table, and said bag-gripping members grip the sealed portion of the top edge of the bag.

* * * * *